US009295921B2

(12) United States Patent
Renforth et al.

(10) Patent No.: US 9,295,921 B2
(45) Date of Patent: Mar. 29, 2016

(54) TOY AND MODULE THEREFOR

(71) Applicant: DOSKOCIL MANUFACTURING COMPANY, INC., Arlington, TX (US)

(72) Inventors: Jack William Renforth, Azle, TX (US); Peter Owen Frickland, Issaquah, WA (US); Kyle Douglas Burger, Seattle, WA (US); Mark Oblack, Issaquah, WA (US); Ryan Wills, Carrollton, TX (US)

(73) Assignee: DOSKOCIL MANUFACTURING COMPANY, INC., Arlington, TX (US)

( * ) Notice: Subject to any disclaimer, the term of this patent is extended or adjusted under 35 U.S.C. 154(b) by 0 days.

(21) Appl. No.: 14/211,848

(22) Filed: Mar. 14, 2014

(65) Prior Publication Data

US 2014/0308875 A1 Oct. 16, 2014

Related U.S. Application Data

(60) Provisional application No. 61/788,822, filed on Mar. 15, 2013.

(51) Int. Cl.

| | |
|---|---|
| ***A63H 33/22*** | (2006.01) |
| ***A63H 33/26*** | (2006.01) |
| ***F21V 33/00*** | (2006.01) |
| *F21Y 101/02* | (2006.01) |

(52) U.S. Cl.

CPC ..... *A63H 33/26* (2013.01); *A63H 33/22* (2013.01); *F21V 33/008* (2013.01); *F21Y 2101/02* (2013.01)

(58) Field of Classification Search

CPC ..... A63B 43/06

USPC ..... 446/485, 175, 219, 484, 220, 570; 74/5.5

See application file for complete search history.

(56) References Cited

U.S. PATENT DOCUMENTS

| | | | | |
|---|---|---|---|---|
| 3,304,651 | A | 2/1967 | Deyerl | |
| 3,417,474 | A * | 12/1968 | Evans et al. | 33/275 R |
| 3,610,916 | A | 10/1971 | Meehan | |
| 4,002,893 | A | 1/1977 | Newcomb et al. | |
| 5,236,383 | A | 8/1993 | Connelly | |

(Continued)

FOREIGN PATENT DOCUMENTS

WO WO9306899 A1 4/1993

OTHER PUBLICATIONS

Nite Ize, Inc.; Meteorlight K-9—LED Ball; http://www.niteize.com/product/Meteorlight-K-9-LED-Ball.asp.

(Continued)

*Primary Examiner* — Gene Kim
*Assistant Examiner* — Rayshun Peng
(74) *Attorney, Agent, or Firm* — Global IP Counselors, LLP

(57) ABSTRACT

A module structured for use with a toy is provided. The module includes a light emitting assembly. The light emitting assembly has a circuit board and a battery assembly. The battery assembly includes an attachment portion coupled to the circuit board and an end portion opposite the attachment portion. The module further includes a housing, the housing having a containing portion and a stabilizing portion extending from the containing portion at a junction. The stabilizing portion is structured to engage the toy and the containing portion is located on the light emitting assembly. The end portion is located between the junction and the circuit board.

20 Claims, 4 Drawing Sheets

(56) References Cited

U.S. PATENT DOCUMENTS

| | | | | |
|---|---|---|---|---|
| 5,775,800 | A * | 7/1998 | Hsieh | 362/295 |
| 7,014,565 | B2 * | 3/2006 | Chang | 473/118 |
| 7,683,275 | B2 | 3/2010 | Moore et al. | |
| 8,025,550 | B2 | 9/2011 | Tsengas et al. | |
| 2005/0032457 | A1 | 2/2005 | Gick | |
| 2005/0261083 | A1 * | 11/2005 | Liao | 473/353 |
| 2007/0087861 | A1 * | 4/2007 | Liao et al. | 473/353 |
| 2013/0029794 | A1 * | 1/2013 | Kortegast | 473/570 |

OTHER PUBLICATIONS

Glo-Balls; http://www.glo-balls.com/light-up-balls-frisbees.html.
Frontgate; http://www.frontgate.com/k9-led-lighted-dog-ball/157118?redirect=y.
petsmart.com; http://www.petsmart.com/product/index.jsp-?productId=24073656.

* cited by examiner

110

TOY AND MODULE THEREFOR

CROSS-REFERENCE TO RELATED APPLICATIONS

This application claims priority from and claims the benefit of U.S. Provisional Patent Application Ser. No. 61/788,822, filed Mar. 15, 2013.

BACKGROUND OF THE INVENTION

1. Field of the Invention

The disclosed concept pertains generally to toys, and more particularly to toys that protect a module within, such as for example a module including a light emitting assembly.

2. Description of the Prior Art

Illuminated toys employing modules for illumination are well known. However, such modules often become damaged over time by repeated use of the toys. There is thus room for improvement in toys. There is also room for improvement in modules therefor.

SUMMARY OF THE INVENTION

These needs and others are met by the disclosed concept, which is directed to a module and toy that advantageously protect a light emitting assembly.

In accordance with one aspect of the disclosed concept, a module structured for use with a toy can generally be stated as including a light emitting assembly and a housing. The light emitting assembly has a circuit board and a battery assembly. The battery assembly includes an attachment portion coupled to the circuit board and an end portion opposite the attachment portion. The housing has a containing portion and a stabilizing portion extending from the containing portion at a junction. The stabilizing portion is structured to engage the toy and the containing portion is located on the light emitting assembly. The end portion is located between the junction and the circuit board.

In accordance with another aspect of the disclosed concept, a toy can generally be stated as including the abovementioned module, a ball having an aperture extending at least partially therethrough, and a cap retained within the aperture.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
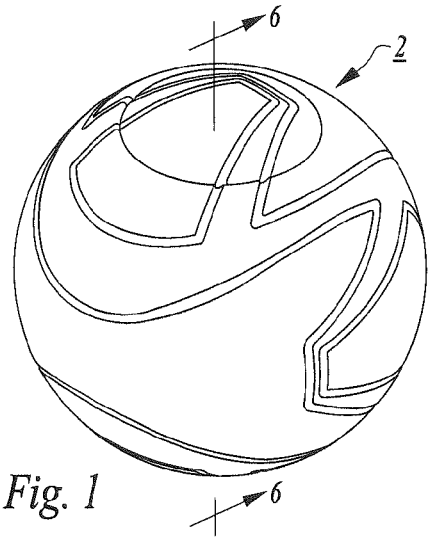
FIG. 1 is an isometric view of a toy in accordance with the disclosed concept.
Figure 2:
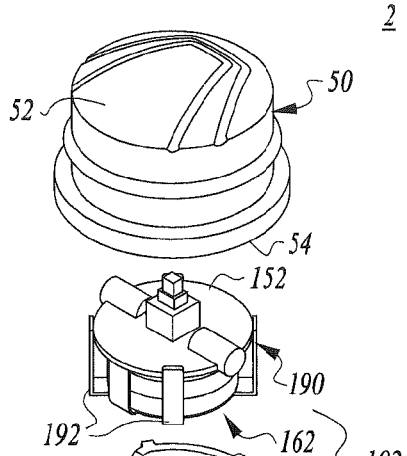
FIG. 2 is an exploded view of the toy of FIG. 1.
Figure 3A:
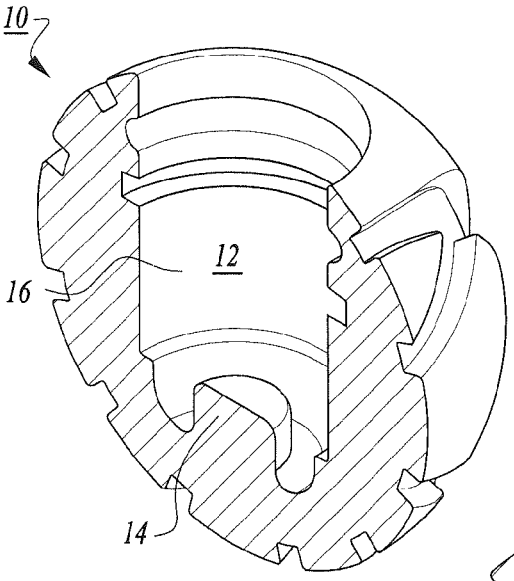
FIG. 3A is a sectional view as taken along line 3A-3A of FIG. 1.
Figure 3B:
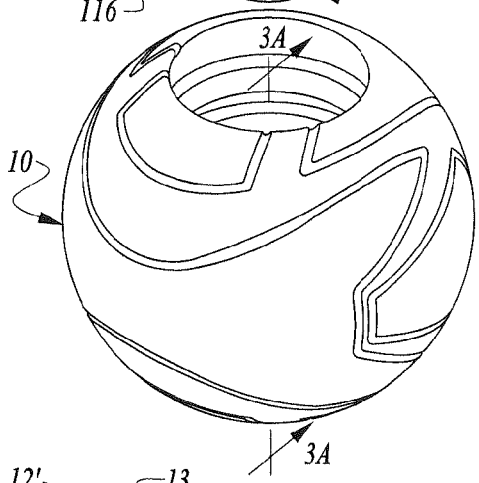
FIG. 3B is an elevational view similar to FIG. 3A.
Figure 3B:
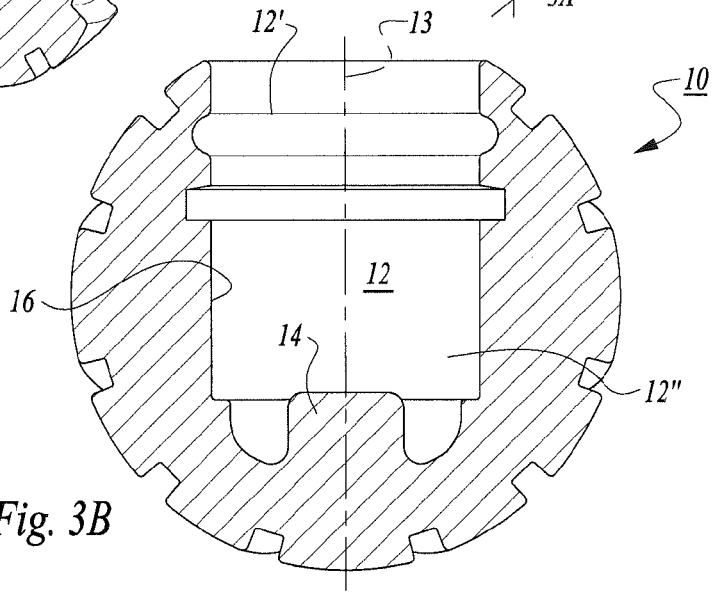

FIGS. 1 and 2 show a toy 2 that includes a ball 10, a module 102 that emits light, and a cap 50. The ball 10 and the cap 50 are made of a durable material (e.g., without limitation, rubber or an elastomer) suitable for play with a dog. Additionally, the ball 10 and the cap 50 are at least partially transparent to light, advantageously allowing light emitted from the module 102 to shine through and be visible to users. In this manner, the toy 2 is suitable for use at any time of day or night. FIGS. 3A and 3B show the ball 10, which has an aperture 12 extending partially therethrough. The aperture 12 is generally cylindrical shaped, having a first portion 12', a second portion 12" opposite the first portion, and a center line 13. The cap 50 is received in the first portion 12' of the aperture 12 and the module 102 is received in the second portion 12" of the aperture 12. Additionally, the ball 10 has an elongated component 14 located near the second portion 12" of the aperture 12 that extends partially into the module 102, as will be set forth in greater detail below.

The module 102 includes a light emitting assembly 150 (FIGS. 4A-4F), a damping pad 190 (FIGS. 7A and 7B) located on the light emitting assembly, and a housing 110 (FIGS. 5A-5F). As seen in FIGS. 4A-4F, the light emitting assembly 150 includes a circuit board 152 and a battery assembly 154. The circuit board 152 includes a first side 153 facing the battery assembly 154 and a second side 153' facing away from the battery assembly 154. The battery assembly 154 includes an attachment portion 160 having a number of coupling members (two coupling members 161 are indicated) coupled to the first side 153 of the circuit board 152. Although the attachment portion 160 is disclosed as having the two coupling members 161, it is within the scope of the disclosed concept to have any suitable alternative number of coupling members. Furthermore, the light emitting assembly 150 also includes a number of light emitting diodes (two light emitting diodes 156 are shown) and a switch 158 for energizing the light emitting diodes 156.

Figure 4A:
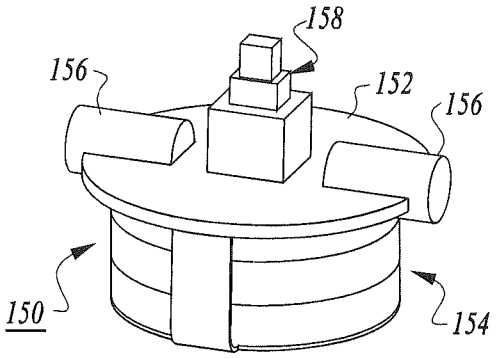
FIGS. 4A-4F are different views of a light emitting assembly of the toy of FIG. 1.
Figure 4B:
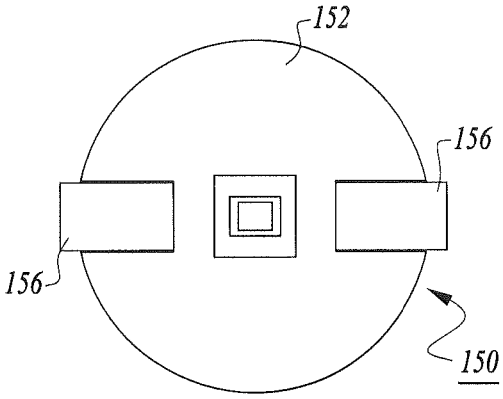
Figure 4C:
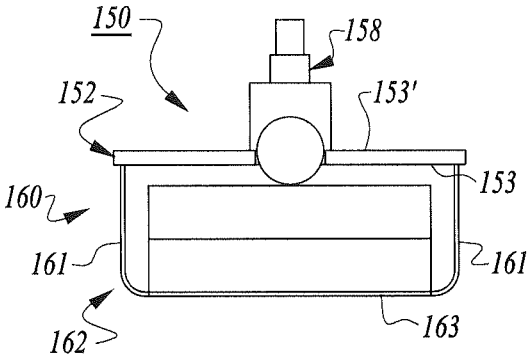
Figure 4D:
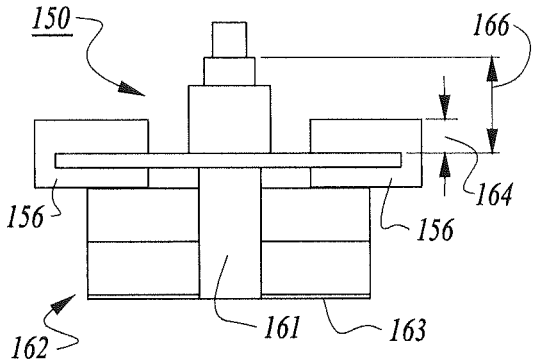
Figure 4E:
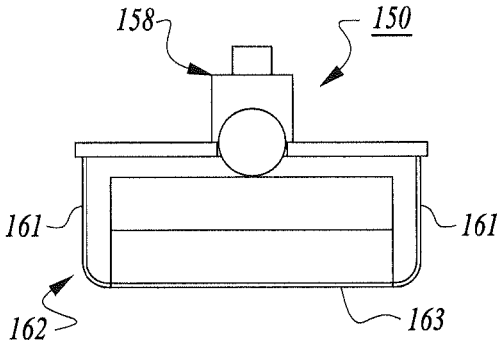
Figure 4F:
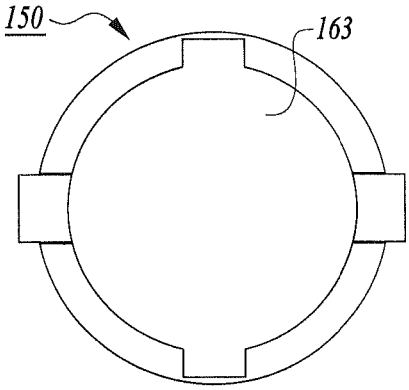

The switch 158 is depicted in FIGS. 4A, 4C, and 4D in an off position. The switch 158 is depicted in FIG. 4E as having been moved to an on position. In this second position, the light emitting diodes 156 are energized. Comparing FIG. 4E to FIGS. 4A, 4C, and 4D, as the switch 158 is movable between a first position where the light emitting diodes 156 are de-energized (FIGS. 4A, 4C, and 4D) and the second position where the light emitting diodes 156 are energized (FIG. 4E), the battery assembly 154 remains fixed with respect to the circuit board 152. As a result, the light emitting assembly 150 is more durable because the only component that moves with respect to the circuit board 152 is the switch 158. Furthermore, referring to FIG. 4D, each of the light emitting diodes 156 extends a first distance 164 from the second side 153' of the circuit board 152 and the switch 158 extends a second distance 166 from the second side 153' of the circuit board 152. As seen, the second distance 166 is greater than the first distance 164. As a result and as will be discussed below in connection with FIG. 6, the light emitting diodes 156 are advantageously well protected because the cap 50 (FIG. 6), which extends into the housing 110, engages the switch 158 and does not extend further to engage the light emitting diodes 156.

FIGS. 5A through 5F show different views of the housing 110 that contains and protects the light emitting assembly 150. As seen, the housing 110 includes a containing portion 112 and a stabilizing portion 114. The stabilizing portion 114 generally includes an elongated stabilizing member 118 extending from a junction 116. The elongated stabilizing member 118 has a hole 120 that receives the component 14 of the ball 10 (FIGS. 3A and 3B), advantageously keeping the module 102 stable with respect to the ball 10.

Figure 5A:
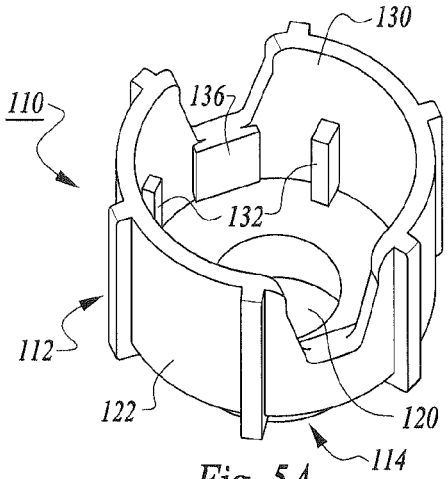
FIGS. 5A-5F are different views of a housing of the toy of FIG. 1.
Figure 5B:
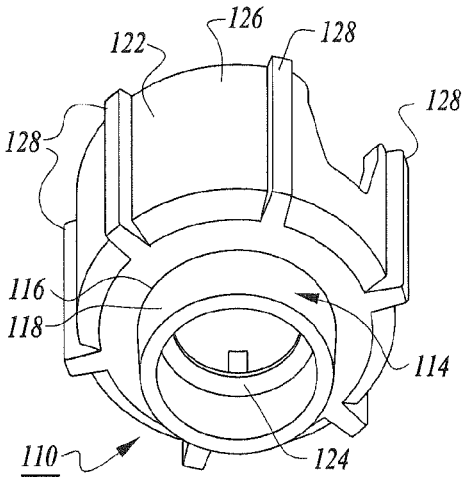
Figure 5C:
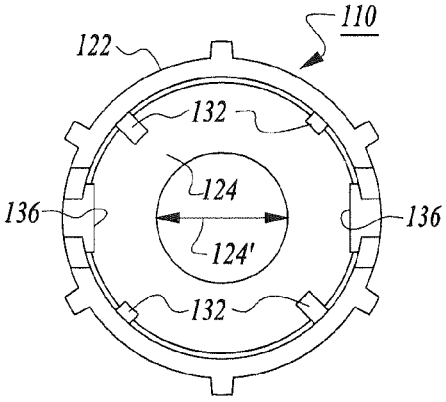
Figure 5D:
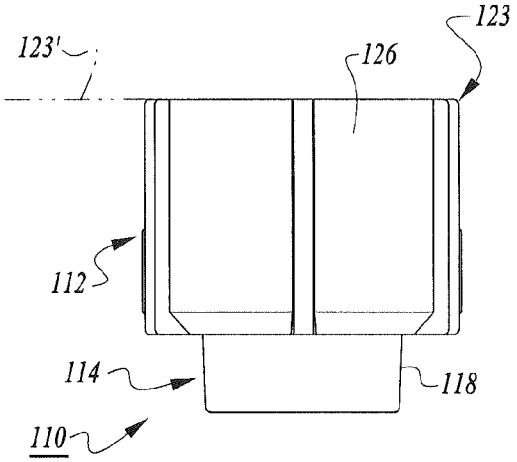
Figure 5E:
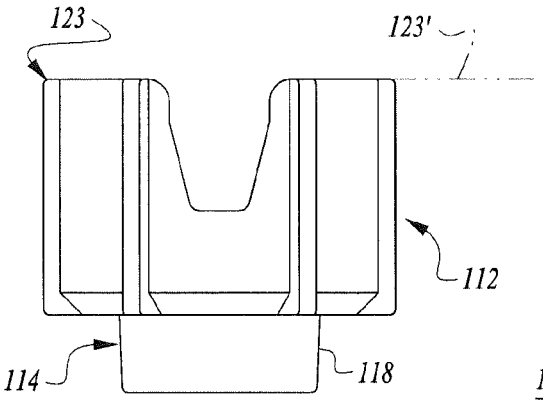
Figure 5F:
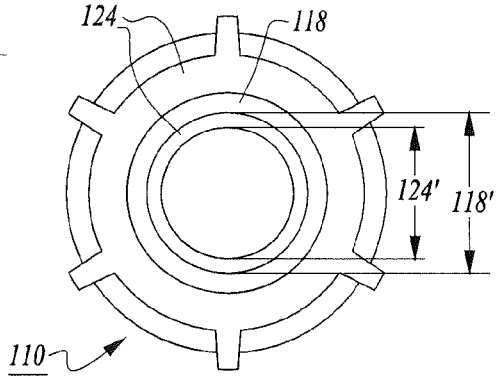
Figure 6:
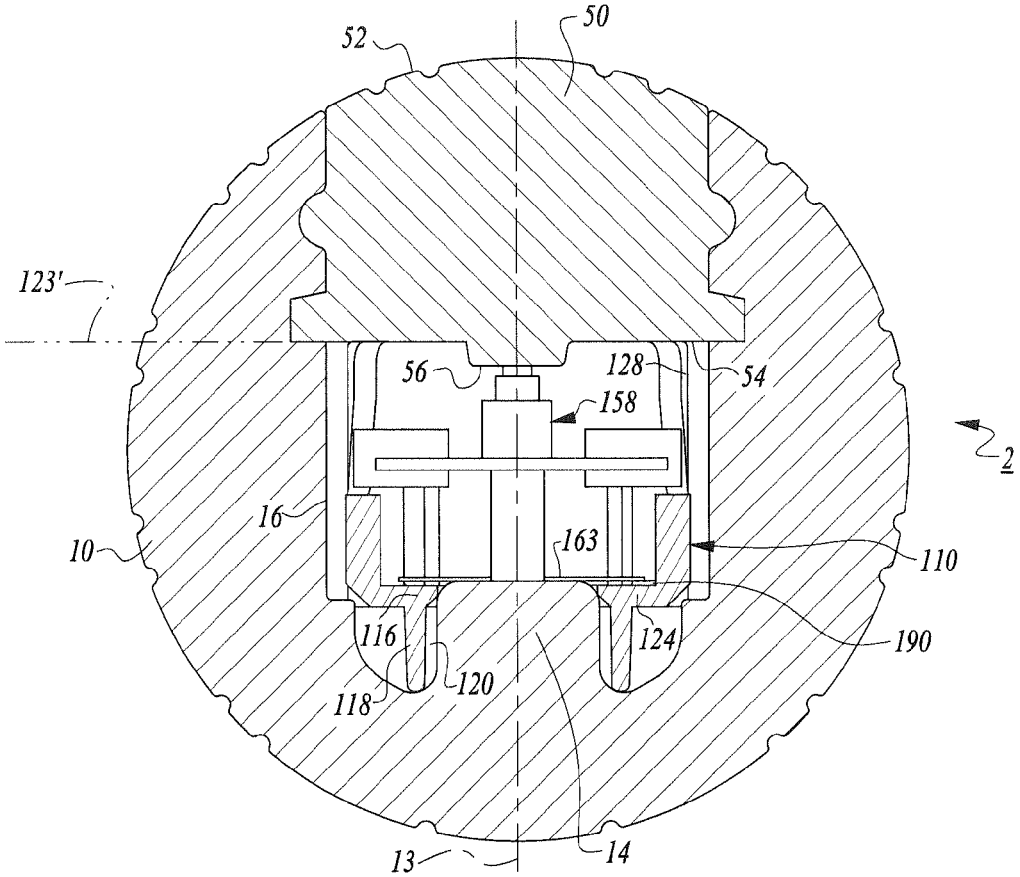
FIG. 6 is a section view of the toy as taken along line 6-6 of FIG. 1.

Continuing to refer to FIGS. 5A-5F, the containing portion 112 generally includes a cylindrical shaped elongated containing member 122 and a platform 124 extending radially inwardly from the elongated containing member 122 and beyond the elongated stabilizing member 118 and into the hole 120. The platform 124 is generally annular shaped and has an inner diameter 124'. Additionally, the battery assembly 154 (FIGS. 4A-4F) includes an end portion 162 having an end surface 163 that faces the platform 124 and is located between the junction 116 and the circuit board 152. Thus, the platform 124 and the stabilizing portion 114 of the housing 110 extend beyond the end portion 162. Referring to FIGS. 5F, 6 and 7B, the end surface 163 is generally circular shaped and has a diameter 163' larger than the diameter 124' of the platform 124, advantageously allowing the light emitting assembly 150 to be supported on the platform 124 within the containing portion 112. Furthermore, as seen in FIG. 5F, the elongated stabilizing member 118 has a diameter 118' greater than the inner diameter 124' of the platform 124.

Continuing to refer to FIGS. 5A through 5F, the elongated containing member 122 has a generally cylindrical outer surface 126. Extending from the outer surface 126 are a plurality of elongated external brace members 128. When the housing 110 is received in the aperture 12, the brace members 128 are located between an inner surface 16 of the ball 10 (FIGS. 3A and 3B) and the outer surface 126 of the containing portion 112. In operation, as the toy 2 engages hard surfaces (e.g., the ground), the brace members 128 keep the housing 110, and the light emitting assembly 150 within, fixed with respect to the ball 10, thus better protecting the light emitting assembly 150 from potentially damaging vibration.

Furthermore, the housing 110 includes a number of elongated internal brace members 132 that likewise serve to protect the light emitting assembly 150. As seen in FIGS. 5A and 5C, the elongated containing member 122 includes a generally cylindrical inner surface 130 and the brace members 132 extend inwardly from the inner surface 130. Additionally, the damping pad 190 (FIGS. 7A and 7B) includes a number of arms (four arms 192 are shown) that each correspond to one of the brace members 132. Each of the arms 192 is located between one of the brace members 132 and the light emitting assembly 150. The damping pad 190 can be made of any suitable material for absorbing impact (e.g., without limitation, a soft silicone material). Together with the brace members 132, the damping pad 190 absorbs impact from the housing 110, advantageously protecting the light emitting assembly 150 located within. As the damping pad 190 is soft, damaging impact from the ball 10 and the housing 110 is thus significantly reduced. As seen in FIGS. 5A and 5C, the housing 110 further includes a pair of protrusions 136 for preventing the light emitting assembly 150 from oscillating with respect to the housing 110.

Figure 7A:
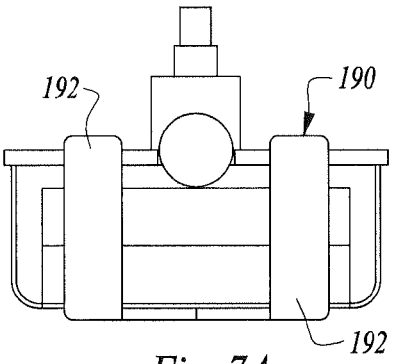
FIGS. 7A and 7B are side and bottom elevation views, respectively, of the light emitting assembly of FIGS. 4A-4E, shown as employed with a damping pad.
Figure 7B:
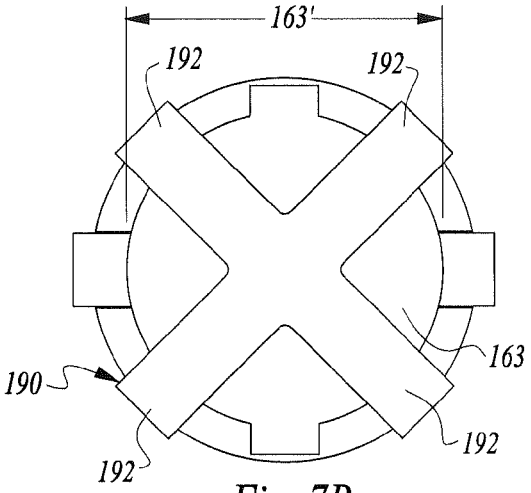

FIGS. 7A and 7B show different views of the damping pad 190 that substantially overlies the hole 120 (FIG. 5A) and is located on the light emitting assembly 150. Although the damping pad 190 has been disclosed as being generally X-shaped (i.e., including the four arms 192), it is within the scope of the disclosed concept to have any suitable alternative shaped damping pad (not shown). For example and without limitation, it is within the scope of the disclosed concept to employ a generally cylindrical shaped damping pad (not shown) surrounding a light emitting assembly.

FIG. 6 shows a section view of the toy 2 taken long line 6-6 of FIG. 1. As seen, the cap 50 includes an outer surface 52, an inner surface 54, and a protrusion 56 extending away from the inner surface 54. Referring to FIGS. 5D and 5E, the housing includes an end portion 123 located in a plane 123'. As seen in FIG. 6, the inner surface 54 of the cap 50 is generally coplanar with the plane 123', with the exception of the protrusion 56. As a result, the protrusion 56 engages the switch 158 and is generally located between the plane 123' and the switch 158. Additionally, as discussed previously in connection with FIG. 4D, as the switch 158 extends a greater distance from the circuit board 152 then the light emitting diodes 156, having the protrusion 56 of the cap 50 only engage the switch 158 rather than the light emitting diodes 156 or the battery assembly 154 results in a better protected light emitting assembly 150.

Continuing to refer to FIG. 6, the component 14 is elongated in a direction collinear with the protrusion 56 of the cap 50 and extends through the hole 120 and the platform 124 and engages the damping pad 190. As a result, the component 14 and the protrusion 56 further operate to support the battery assembly 154 and the light emitting assembly 150 along the center line 13. Additionally, the brace members 128 are each elongated in a direction parallel to the center line 13, advantageously allowing forces from impact of the toy 2 on a hard surface to be more evenly distributed to the housing 110.

The specific elements that have been illustrated in the Figures and described in the specification are simply exemplary embodiments of the disclosed concept and have been provided as non-limiting examples solely for the purpose of illustration. The embodiments were chosen and described in order to best explain the principles of the invention and its practical application to thereby enable others skilled in the art to best utilize the invention in various embodiments and various modifications. It is intended that the appended claims be construed to include other alternative embodiments of the invention except insofar as limited by the prior art.

What is claimed is:

1. A module structured for use with a toy, the module comprising:

a light emitting assembly comprising a circuit board, a number of light emitting diodes disposed on said circuit board, and a battery assembly, said battery assembly comprising an attachment portion coupled to said circuit board and an end portion opposite said attachment portion; and a housing comprising a containing portion and a stabilizing portion extending from said containing portion at a junction, the stabilizing portion being structured to engage the toy, the containing portion being disposed on said light emitting assembly;

wherein the end portion is disposed between said junction and said circuit board;

wherein the containing portion comprises an elongated member comprising a distal portion disposed opposite and distal from the junction;

wherein each of the number of light emitting diodes is disposed between the distal portion and the junction; and wherein each of the number of light emitting diodes is spaced from at least one of the distal portion and the junction.

2. The module of claim 1 wherein said circuit board comprises a first side and a second side opposite said first side; wherein said attachment portion of said battery assembly is coupled to said first side; wherein said light emitting assembly further comprises a switch; and wherein said switch extends from said second side and is structured to energize said number of light emitting diodes.

3. The module of claim 2 wherein said switch is structured to move between a first position and a second position; wherein in said first position said number of light emitting diodes are de-energized and in said second position said number of light emitting diodes are energized; and wherein as said switch moves between said first position and said second position, said battery assembly remains fixed with respect to the circuit board.

4. The module of claim 2 wherein each of said number of light emitting diodes extends a first distance from the second side of said circuit board; wherein said switch extends a second distance from the second side of said circuit board, the second distance being greater than the first distance; wherein each of said number of light emitting diodes is entirely disposed between the distal portion and the junction.

5. The module of claim 1 wherein the stabilizing portion comprises another elongated member extending from said junction, said another elongated member having a through hole being structured to receive a corresponding portion of the toy.

6. The module of claim 5 further comprising a damping pad disposed between said end portion of said battery assembly and said junction, said pad substantially overlying said through hole.

7. The module of claim 1 wherein said containing portion further comprises a platform extending radially from said elongated member; wherein said end portion of said battery assembly has an end surface facing said platform.

8. The module of claim 7 wherein said platform is annular shaped and has an inner diameter; and wherein said end surface is generally circular shaped and has a diameter greater than the inner diameter of said platform.

9. The module of claim 7 wherein said stabilizing portion comprises another generally cylindrical shaped elongated member having a diameter greater than said inner diameter of said platform.

10. The module of claim 1 wherein said elongated member has a generally cylindrical outer surface having a plurality of elongated external brace members extending outwardly therefrom.

11. The module of claim 10 further comprising a damping pad having a plurality of arms; wherein said elongated member comprises a generally cylindrical inner surface opposite said outer surface, said inner surface having a plurality of elongated internal brace members extending inwardly therefrom; and wherein each of said arms of said damping pad is disposed between a corresponding one of the internal brace members and said light emitting assembly.

12. A toy comprising:

a module comprising a light emitting assembly comprising a circuit board and a battery assembly, the battery assembly comprising an attachment portion coupled to the circuit board and an end portion opposite the attachment portion, and a housing comprising a containing portion and a stabilizing portion extending from the containing portion at a junction, the stabilizing portion being structured to engage the toy, the containing portion being disposed on the light emitting assembly;

a ball having an aperture extending partially therethrough; and a cap retained within the aperture, the end portion being disposed between the junction and the circuit board, the circuit board comprising a first side and a second side opposite said first side, the attachment portion of the battery assembly being coupled to the first side, the light emitting assembly further comprising a plurality of light emitting diodes disposed on the circuit board and a switch, the switch extending from the second side and being structured to energize the light emitting diodes, the cap comprising an outer surface, an inner surface disposed opposite the outer surface, and a protrusion extending in a direction generally away from the inner surface and engaging the switch.

13. The toy of claim 12 wherein the containing portion has an end portion disposed in a plane, the inner surface of the cap being coplanar with the plane, the protrusion being generally disposed between the switch and the plane.

14. The toy of claim 12 wherein the aperture has a first end portion disposed proximate the cap and a second end portion opposite the first end portion, the ball comprising a component disposed proximate the second end portion, the component being elongated in a direction generally collinear with the protrusion of the cap.

15. The toy of claim 14 wherein the stabilizing portion comprises an elongated member extending from the junction, the elongated member having a through hole, the component extending through the through hole of the elongated member.

16. The toy of claim 14 wherein the containing portion comprises a generally cylindrical shaped elongated member and an annular platform extending radially from the member, the end portion of the battery assembly having an end surface facing the platform, the component extending through the platform.

17. The toy of claim 12 wherein the containing portion comprises a generally cylindrical outer surface having a plurality of external brace members extending outwardly therefrom, the ball comprising a cylindrical shaped inner surface, each of the plurality of brace members being disposed between the cylindrical shaped inner surface of the ball and the generally cylindrical outer surface of the containing portion.

18. The toy of claim 17 wherein the aperture is generally cylindrical shaped and has a center line, each of the plurality of brace members being elongated in a direction parallel to the center line.

19. The toy of claim 12 wherein the protrusion extends into the containing portion and moves the switch between a first position and a second position.

20. The toy of claim 14 wherein the elongated component is spaced from each of the plurality of light emitting diodes and the circuit board.

* * * * *